US009610218B2

(12) United States Patent
Jensen

(10) Patent No.: US 9,610,218 B2
(45) Date of Patent: Apr. 4, 2017

(54) DEVICE FOR ACCOMMODATING A DRUG BLISTER

(71) Applicant: Boehringer Ingelheim International GmbH, Ingelheim am Rhein (DE)

(72) Inventor: Thomas Hogh Jensen, Mainz (DE)

(73) Assignee: Boehringer Ingelheim International GmbH, Ingelheim am Rhein (DE)

( * ) Notice: Subject to any disclaimer, the term of this patent is extended or adjusted under 35 U.S.C. 154(b) by 0 days.

(21) Appl. No.: 14/400,799

(22) PCT Filed: May 10, 2013

(86) PCT No.: PCT/EP2013/059717

§ 371 (c)(1),
(2) Date: Nov. 13, 2014

(87) PCT Pub. No.: WO2013/171129

PCT Pub. Date: Nov. 21, 2013

(65) Prior Publication Data

US 2015/0136640 A1 May 21, 2015

(30) Foreign Application Priority Data

May 14, 2012 (EP) ..... 12167813

(51) Int. Cl.

| | |
|---|---|
| ***A61J 1/03*** | (2006.01) |
| ***A61J 7/04*** | (2006.01) |
| ***B65D 83/04*** | (2006.01) |

(52) U.S. Cl.

CPC ..... *A61J 1/035* (2013.01); *A61J 7/04* (2013.01); *B65D 83/0463* (2013.01); *B65D 2583/0409* (2013.01)

(58) Field of Classification Search

CPC ..... A61J 1/035; A61J 1/03; A61J 7/04; B65D 83/0463; B65D 83/0445; B65D 83/0409; B65D 75/327; B65D 75/326; B65D 75/325; B65D 83/04

USPC ..... 206/534, 532, 538, 528, 484; 221/87, 88

See application file for complete search history.

(56) References Cited

U.S. PATENT DOCUMENTS

| | | | | |
|---|---|---|---|---|
| 4,074,806 A * | 2/1978 | Ardito | B65D 83/0463 | 206/531 |
| 4,384,649 A * | 5/1983 | Brodsky | B65D 83/0463 | 206/532 |
| 4,905,866 A * | 3/1990 | Bartell | B65D 83/0463 | 206/531 |
| 5,019,125 A * | 5/1991 | Rebne | B65D 83/0463 | 206/528 |
| 5,431,283 A | 7/1995 | Weinstein et al. | | |

(Continued)

FOREIGN PATENT DOCUMENTS

| | | |
|---|---|---|
| EP | 2336045 A1 | 6/2011 |
| WO | 2013171129 | 11/2013 |

OTHER PUBLICATIONS

International Search report and Written opinion for PCT/EP 2013059717 mailed Jun. 7, 2013.

*Primary Examiner* — Steven A. Reynolds
(74) *Attorney, Agent, or Firm* — Michael P. Morris; Philip I. Datlow

(57) ABSTRACT

The present invention relates to a novel device for accommodating and storing blister packs, particularly pharmaceutical blisters, and for releasing a tablet or capsule from the blister pack using a means for punching the cover film of the blister.

10 Claims, 4 Drawing Sheets

(56) References Cited

U.S. PATENT DOCUMENTS

| | | | | | |
|---|---|---|---|---|---|
| 5,853,101 | A * | 12/1998 | Weinstein | B65D 5/42 | 206/532 |
| 5,909,822 | A * | 6/1999 | George | B65D 83/0463 | 206/531 |
| 6,155,424 | A * | 12/2000 | Dubach | B65D 83/0463 | 206/531 |
| 6,155,454 | A * | 12/2000 | George | B65D 83/0463 | 206/531 |
| 7,252,208 | B1 * | 8/2007 | Alvino | B65D 83/0463 | 221/28 |
| 2009/0095649 | A1 * | 4/2009 | Costa | B65D 83/0463 | 206/530 |

* cited by examiner

DEVICE FOR ACCOMMODATING A DRUG BLISTER

This application is the national phase entry under 35 U.S.C. §371 of International Application No. PCT/EP2012/059717, filed May 10, 2013, which claims priority to EP 12167813.0, filed May 14, 2012, the contents of which are hereby incorporated by reference in their entireties.

The invention relates to a device for accommodating and storing blister packs, particularly pharmaceutical blisters, which ensures the integrity of the blister and which is characterised in that individual pharmaceutical units, such as, e.g., tablets or capsules can be individually released from the blister and taken out of the device.

Numerous pharmaceutical products are brought onto the market in the form of tablets in blisters, some of these tablets being relatively small and difficult to handle, particularly by older people with reduced mobility in their hands. A special device that is easy to manipulate and capable of removing an individual tablet from a blister makes the handling of the tablet easier.

By a tablet is meant, for the purposes of the invention, not only compressed powder, powder mixture or granules with or without a coating but also suitably filled capsules or coated tablets. In one particular embodiment, the invention relates to a device for accommodating blister packs, particularly pharmaceutical blisters, the blister pack containing a pharmaceutical capsule consisting of gelatine or hydroxypropylmethylcellulose (HPMC) which has been filled with a powder or granules.

Thus there is a need to provide a device for accommodating blister packs of the type mentioned hereinbefore which, while being simple in construction, makes it possible (i) on the one hand to store the medicament, e.g., tablet, in the blister in protected manner in conformity with the pharmaceutical requirements of the medicament, and on the other hand (ii) to remove the medicament from the blister by a simple action using the device. In particular, the device claimed ensures that the patient is able to remove the product at regular times, while the blister pack protects the medicament from external influences until just before it is taken.

According to the invention the problem is solved by the features of claim 1. The sub-claims constitute advantageous embodiments of the invention.

PRIOR ART

Tablet dispensers that constitute devices having a housing for storing tablets and with the function of making an individual tablet available by actuation of a releasing means are known in the art (WO 2004/026728, EP0822151). Also known in the art are devices that are suitable for accommodating a blister pack and that comprise a means or one or more punches by means of which the tablets can be individually pressed out of the blister, so that these tablets pressed out of the blister are available to the patient (U.S. Pat. No. 4,074,806, DE4134237, WO8909042).

By a blister, particularly a pharmaceutical blister, is meant a film container having two particularly rectangular films joined together around their periphery, to form a receiving chamber for a filling, particularly a pharmaceutical active substance formulation. The film containers serve inter alia to protect pharmaceutical active substance formulations from external environmental influences which might under certain circumstances affect the pharmaceutical quality of the active substance formulation.

Blisters for medicaments consist of a base film or base plate which has a plurality of cavities arranged, for example, in a circle or oval. The individual cavities each contain a tablet or capsule that contains the active substance formulation. Typically, by a blister pack is meant a cold-formed or thermoformed blister base part that contains cavities for accommodating a medicament, e.g., the tablets or capsules, the base part being sealingly connected to a cover film to form a seal.

The cover film and the base film may be made up of one or more layers of different or identical materials. The cover film is sealingly connected to the base film, for example, by adhesive bonding, welding or sealing. The cover film and/or the carrier film is generally embodied as a metal and/or plastics and/or paper film. These materials may be present in several layers. Typical metal films comprise, for example, aluminium foils and composite aluminium films made from aluminium and, for example, a plastics material. Suitable materials for the plastics films may be polyvinylchloride (PVC), cycloolefin copolymer (COC), polychlorotrifluoroethylene (PCFE), polyethylene (PE), polypropylene (PP), polyethylene terephthalate (PET), polycarbonate (PC), polyester (UP), polyacrylate, polyamide (PA) or other plastics. Often, a blister consists of an aluminium cover film and a base film for accommodating the pharmaceutical product in the cavities of the base film.

The thermoformed base film may also be an aluminium film. Similarly the base films may consist of polyvinylchloride (PVC), polyvinylidene chloride (PVDC), polypropylene (PP), polyethylene terephthalate (PET), polyethylene (PE) and composite films such as PVC/ACLAR® (PCTFE), PVC/PVDC and COC or FORMPACK® (Al—Al blister).

In one specific embodiment blisters may be produced in the form of a push-through blister. By a push-through blister is meant a blister in which the medicaments, such as e.g., capsules, tablets and coated tablets, can be individually removed from the blister by pressing out the wells (cavities) that contain the tablets, capsules or coated tablets. In contrast, in another particular embodiment, the blister may be embodied such that the integrity of the blister cavity and consequently of the cover film is maintained even when attempts are made to reach the medicament, although this is not possible, by applying pressure to the well. Blisters of this kind that do not allow the product to be accessed by pressing on the well are not push-through blisters (and are referred to hereinafter as non-push-through blisters).

Blisters which, by their technical design, do not allow the medicament, e.g. the tablet, to be accessed by pressing onto the cavity (well) but instead have a different opening mechanism (non-push-through blisters) are known in the art. For example, non-push-through blisters of this kind confer increased protection for the medicament against external environmental influences and/or meet particular requirements in terms of child safety, as the medicament cannot be accessed simply by pressing on the blister cavity. Blisters of this kind are disclosed, for example, in U.S. Pat. No. 3,941,248, U.S. Pat. No. 4,243,144, U.S. Pat. No. 3,811,564, U.S. Pat. No. 3,921,805, U.S. Pat. No. 6,422,391, U.S. Pat. No. 3,924,746 and WO 2006/067096.

The problem of the invention is to provide a device of the type mentioned hereinbefore which is suitable for accommodating and storing a blister, and which contains a means for opening the individual cavities of a blister, the functionality of the opening mechanism also being suitable for use on non-push-through blisters.

DESCRIPTION OF THE INVENTION

According to the invention the problem is solved by a device which is suitable for accommodating and storing a blister pack (4), particularly a blister for medicaments, and for releasing a tablet or capsule (12) from the blister pack (4), which is characterised in that the device contains a means (3) by which the cover film of a blister well (5) is punched around the tablet or capsule (12) by the actuation of a button (10) and the tablet or capsule (12) can subsequently be taken out of the blister well (5).

Within the meaning of the present invention, the term button is to be understood as a movable area which when operated mechanically, e.g., with a finger, causes actuation of the means (3). The means (3) here comprise a tool, e.g., a cutting edge, which serves to cut open the cover film. Within the meaning of the present invention, the term blister pack is to be taken as synonymous with blister and particularly represents a pharmaceutical blister. According to the normal definition, a blister consists of a base film that is welded to a cover film, the blister having cavities which serve to receive a tablet or capsule or a coated tablet. The cavities can be produced, for example, by shaping (thermoforming) the base film and are hereinafter also referred to as blister wells. Blisters, particularly pharmaceutical blisters, thus consist of a thermoformed base film which contains blister wells formed therein into which the medicament (tablet or capsule) is placed, the filled blister wells being closed off by sealing with a cover film. The cover film thus has a substantially planar level, whereas the base film comprises mouldings (blister wells).

In another embodiment according to the invention, the invention comprises a device of the kind described hereinbefore or hereinafter, which is characterised in that the device comprises an upper part (1) and a lower part (2), the lower part (2) being of a tub-like configuration for accommodating a blister (4) and comprising retaining elements (6), which acts as a (uniform) support structure (6), and which is suitable for fixing the blister (4) in the lower part (2), wherein the mouldings of the blister wells (5) point towards the lower part (2) as the blister is inserted and thus the blister (4) is also secured against lateral movement and the base height of the support structure (6) corresponds at least to the depth of indentation of the blister well (5).

The term retaining elements (6) for the purposes of the invention refers to means that ensure that the blister wells in the lower part of the device are protected against movement of the blister within the lower part and positioned such that the blister well is cut open by the application of the punching means (3). The retaining elements also serve as a support structure (6), so that during the application of the punching means (3), which exerts a directed mechanical force on the cover film in the direction of the blister well, it is ensured that the blister well is not pressed against the lower part. In one particular embodiment, the retaining elements (6) may take the form of a wall which partially or totally surrounds the blister wells.

In another embodiment the lower part may comprise further means (8*a*), (8*b*) for fixing the blister in the lower part. The fixing means (8*a*), (8*b*) serve to prevent the blister from accidentally falling out, for example, if the opened device is turned upside down. The fixing means may take the form of struts on the long side of the lower part underneath which the blister can be pushed or clamped into the lower part.

Expediently, the blister is pushed or clamped into the lower part by bending the blister in the longitudinal direction and at the same time positioning the blister edge under the fixing means (8*a*), (8*b*). Advantageously, the fixing means (8*a*), (8*b*) in conjunction with the retaining elements (6) ensure that the device according to the invention can be used for blisters with different outer dimensions, provided that the distance between the blister wells and the size of the blister wells is comparable between blisters with different outer dimensions.

In another embodiment, the device consisting of an upper part and a lower part may be configured such that the lower part consists of a tub-shaped base part and an insert that fits it. The insert serves to accommodate the blister and accordingly comprises retaining elements (6) which serve as a (uniform) support structure (6). Similarly, the insert contains the fixing means (8*a*), (8*b*) for fixing the blister. Optionally the insert may contain a support structure (9) which ensures that the device made up of upper part and base part with an insert in which a blister is placed is held in the holding position, i.e., in the position before the punching means (3) is actuated, and the cutting edge and/or the teeth is or are positioned at a spacing from the cover film of the blister (4).

In another embodiment according to the invention, the invention comprises a device of the kind described hereinbefore and hereinafter which is characterised in that the device comprises an upper part (1) and a lower part (2), the upper part (1) containing means (3) for punching out the tablet or capsule (12), and the punching means (3) is in the shape of a wall with a cutting edge and/or teeth, so that when the means (3) is actuated the cutting edge and/or teeth cut open the cover film of a blister well (5). According to the invention the terms "means (3) for punching out" the tablet or capsule (12) and "punching means" are synonymous. Preferably, the punching means is in the form of a wall with a cutting edge directed towards the cover film. In a particular embodiment, the cutting edge is provided with teeth that converge to a point. This embodiment has the effect that upon actuation of the punching means (3) first the cover film is punctured/perforated and subsequently the cover film is torn or cut open along the cutting line of the punching means.

In another embodiment according to the invention the invention comprises a device of the kind described hereinbefore or hereinafter which is characterised in that, before the actuation of the means (3) for punching out the tablet or the capsule, the holding position of the cutting edge and/or teeth of the punching means (3) is spaced by a support structure (9) and/or a strut (7) from the cover film of the blister (4) placed in the device, and after actuation of the punching means (3) the cutting edge and/or the teeth make a circular, segment-shaped, semicircular, arcuate or oval cut in the cover film at a spacing from the tablet or capsule (12).

According to the invention the support structure (9) and/or the strut (7) ensures that when not in operation the punching means (3) are positioned in the holding position, free from any contact with the cover film of the inserted blister. By the holding position is meant the starting position (resting position) of the punching means, i.e. the position of the punching means before actuation thereof. Preferably, this ensures that the cutting edge and/or the teeth of the punching means are spaced at least 1 mm from the cover film. More preferably, the spacing is at least 2 mm. More preferably, the distance is 1-3 mm. More preferably, the spacing is 1-2 mm. In another embodiment, the device according to the invention additionally contains a cover for the upper part, which is configured so as to prevent accidental operation of a button for actuating the punching means (3). The cover is consequently configured such that the operating areas for the punching means (3) are not accessible until after the cover has been opened or removed.

In another embodiment according to the invention, the invention comprises a device of the kind described hereinbefore or hereinafter which is characterised in that after actuation of the punching means (3) the cutting edge and/or the teeth penetrate the cover film by 1 or at most 2 mm.

In another preferred embodiment of the device according to the invention the wall-like cutting edge and/or teeth of the punching means (3) have a free internal diameter which is larger than the diameter/outer circumference of the tablet or capsule.

In another embodiment according to the invention the invention comprises a device of the kind described hereinbefore or hereinafter which is characterised in that the device is suitable for accommodating an at least 2-row blister (4) and the upper part (1) contains a strut (7) which when the device is closed presses the blister into the lower part, thus ensuring that in the resting position the cutting edge and/or teeth of the punching means are spaced from the cover film of the blister (4).

The invention also encompasses a kit consisting of the device according to the invention and a two-row blister, or a kit consisting of the device and parts of divisible blisters, so that the total number of blister wells is an even number.

In another embodiment according to the invention the invention comprises a device of the kind described hereinbefore or hereinafter which is characterised in that the upper part (1) including the means (3) for punching the tablet or the capsule (12) out of the blister (4) and the strut (7) for spacing the punching means (3) of the upper part (1) from the cover film of the blister is made from a single plastics part, the means (3) for punching out the tablet or the capsule (12) being movably attached to the cover, while the circular, segment-shaped, semicircular, arcuate or oval means are separated from the cover by a slot, apart from a connecting point, so that the punching means are attached to the cover only on one side, the connecting point being in the form of a pivot, and the pivot optionally having a material attenuation along the pivot line, and the punching means (3) being capable of being resiliently lowered onto it by pressing. The invention also encompasses an embodiment which is characterised in that the upper part contains the punching means (3) in the form of a tab or flap, the tab or flap being attached to the upper part on one side, in the form of a pivot. According to the invention, the connection between the punching means and the upper part is preferably of resilient configuration. The invention also encompasses an embodiment which is characterised in that the upper part including the punching means (3) constitutes a single component that is made of plastics, preferably by injection moulding.

In another embodiment according to the invention, the invention comprises a device of the kind described hereinbefore or hereinafter, which is characterised in that the device has the capacity to accommodate the requisite patient medication that the patient will need for 7 days, the medication being administered twice a day, in the morning and evening, and the button for actuating the means for punching out the tablet or capsule is characterised by a symbol (11*a*) or (11*b*), so that the medication can be assigned to a morning or evening administration, and characterised in that the device comprises markings (13) which permit allocation of the medication that is needed on a particular day of the week, e.g. "Monday", "Tuesday", "Wednesday", "Thursday", "Friday", "Saturday", "Sunday".

In another embodiment according to the invention the invention comprises a device of the kind described hereinbefore or hereinafter which is characterised in that the blister (4) contains a pharmaceutical formulation containing dabigatran etexilate.

In another embodiment according to the invention the invention comprises a device of the kind described hereinbefore or hereinafter which is characterised in that the blister (4) contains inhalation capsules as the medicament, preferably inhalation capsules which contain the active substance tiotropium.

The invention also encompasses the use of a means (3) for punching the cover film of a blister well (5) so that after the punching operation a tablet or capsule (12) can be taken out of the blister well (5).

The invention also encompasses the use of a means (3) for punching the cover film of a blister well (5) so that after the punching operation a tablet or capsule (12) can be taken out of the blister well (5), characterised in that the means (3) are contained in a device which is suitable for storing a pharmaceutical blister (4).

According to the invention the device claimed is made of plastics, e.g. of polyolefin, polyethylene, polypropylene or polycarbonate. Preferably, the device consists of 2 parts (upper part and lower part) or 3 parts (upper part and lower part, the lower part consisting of a tub-shaped base part and an insert for accommodating the blister). The invention optionally also comprises a cover for the device. The invention also encompasses a method of manufacturing the device, characterised in that the individual parts of the device are produced by injection moulding.

The invention is hereinafter explained in more detail by means of an exemplifying embodiment with reference to the associated drawings, wherein.

Figure 1:
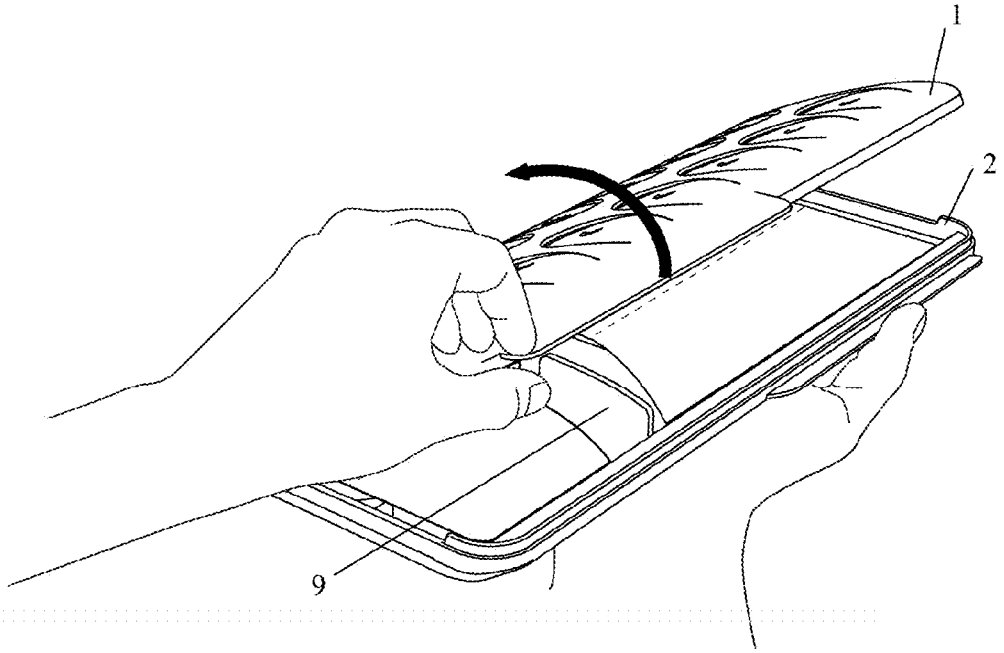
FIG. 1 is a plan view of a device according to the invention for accommodating a blister pack and for releasing a tablet or capsule from the blister pack.

LIST OF REFERENCE NUMERALS (1) upper part of the device (2) lower part of the device (3) punching means/means with a cutting edge and/or teeth for cutting open the cover film of a blister well (4) blister pack/blister/pharmaceutical blister (5) blister well (6) retaining elements/support structure (7) strut in the upper part for keeping the punching means at a spacing from the cover film of the blister in the resting position (8*a*) strut for fixing the blister to the lower part of the device (8*b*) strut for fixing the blister to the lower part of the device (9) support structure for keeping the punching means at a spacing from the cover film of the blister in the resting position of the punching means (10) operating area/button, by means of which the punching means can be resiliently lowered by pressing on it (11*a*) symbol as an indicator to enable the dose of medicament to be assigned to a time of day (e.g., sun=morning)

(11*b*) symbol as an indicator to enable the dose of medicament to be assigned to a time of day (e.g., moon=evening/before bed)

(12) tablet or capsule (13) marking that enables the medication to be assigned to a particular day of the week, e.g.: "Monday", "Tuesday", "Wednesday", "Thursday", "Friday", "Saturday", "Sunday".

FIG. 1 shows the device according to the invention consisting of an upper part and a lower part, wherein a blister can be placed in the device after the device has been opened.

Figure 2:
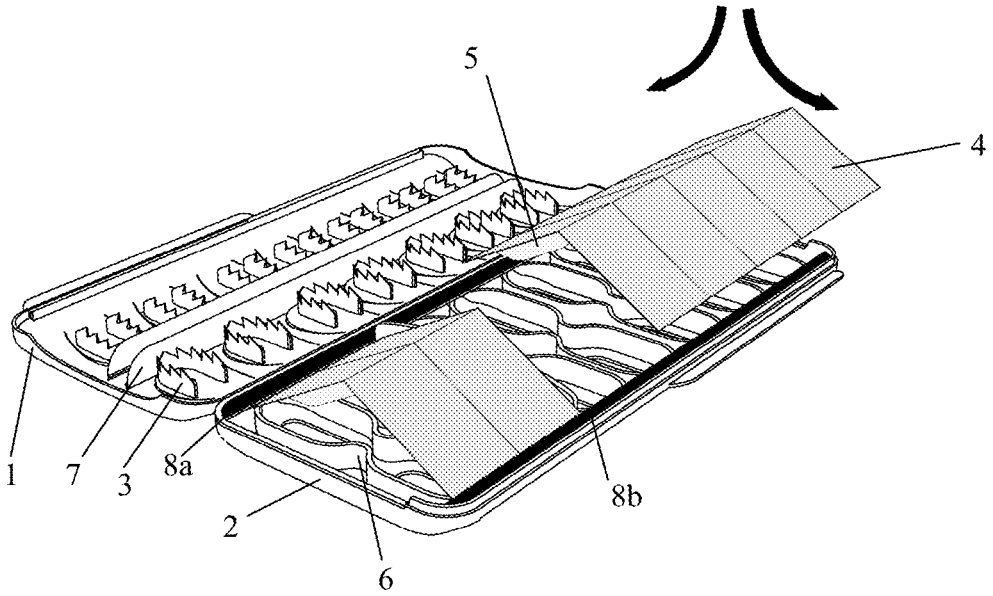
FIG. 2 shows an opened device according to the invention, in which a blister is pushed into the lower part of the device as indicated by the arrows and is secured in the lower part.

FIG. 2 shows the opened device. Integrated in the upper part (1) are the punching means (3). Typically, the device contains the same number of punching means as there are blister wells (5) contained in the blister or blisters (optionally parts of blisters) that are to be accommodated. A blister or a part of a divisible blister can be placed in the lower part by insertion in the fixing means (8*a*), (8*b*), so that the blister wells (5) are protected from moving within the lower part by the retaining elements (6). The support structure (6) in addition to its function as a retaining element also acts as a means of protecting the blister wells from being deformed.

Figure 3:
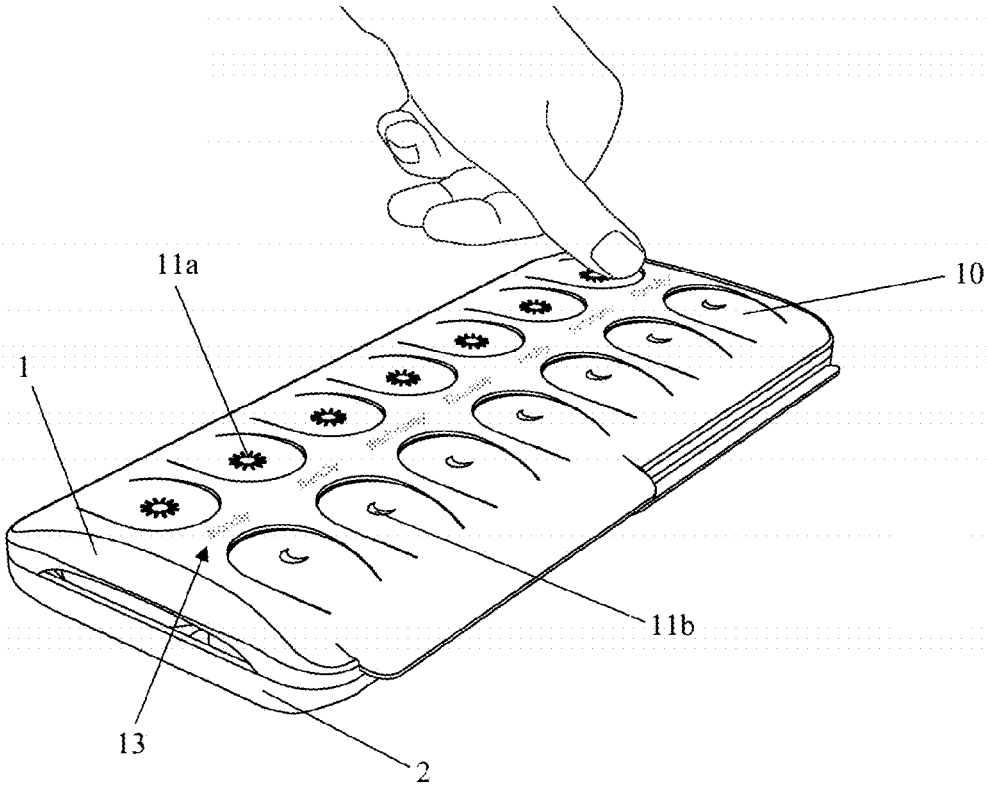
FIG. 3 shows the closed device according to the invention (with the blister inserted—not visible), wherein the punching means is actuated by operating a button.

FIG. 3 shows the closed device, while by pressing on an operating area/button (10) in the shape of a tab the integrated punching means can be pressed into the cover film of the blister placed therein (not visible). The actuating areas/buttons (10) are provided with symbols that enable the patient to see whether the corresponding medication (tablet or capsule) is to be taken in the morning (11*a*) or evening (11*b*). The upper part may additionally contain markings (13) that enable the medication to be assigned to a particular time when it should be taken, e.g. day of the week.

Figure 4:
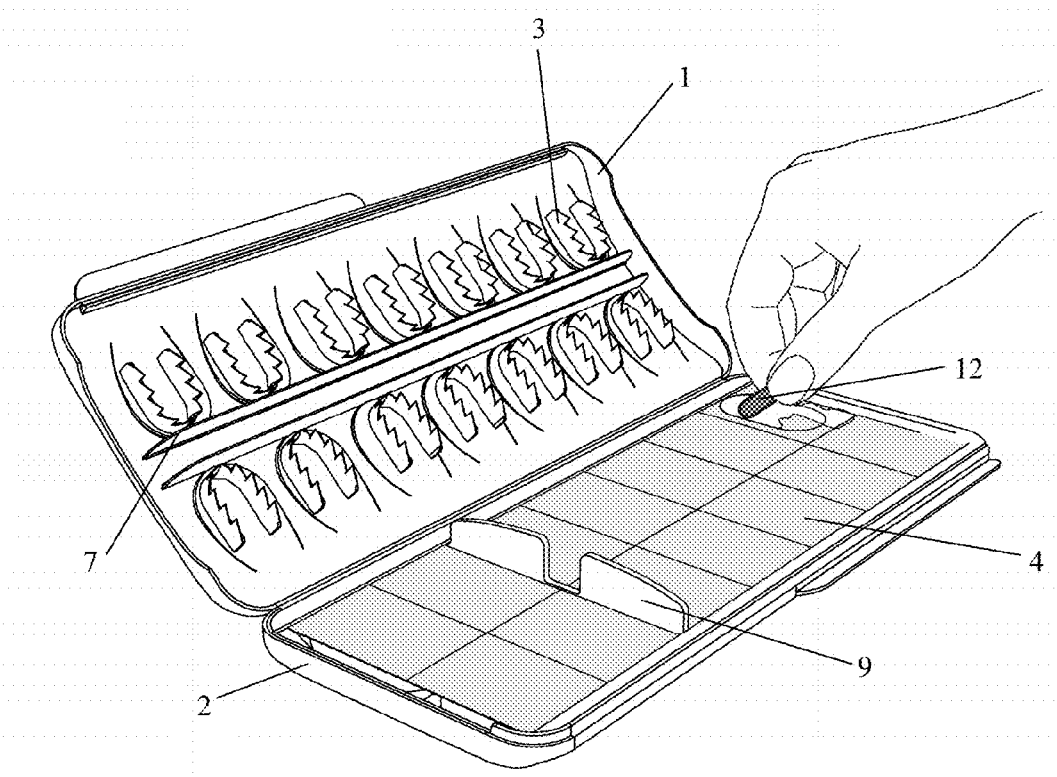
FIG. 4 shows an opened device containing a blister after the punching operation, in which the cover film of a blister well has been cut open by the punching operation and the exposed capsule can be removed from the blister well.

FIG. 4 shows the opened device containing a blister after the punching operation has taken place. After the cover film has been punched and the device opened the tablet or capsule can then be taken out of the blister well.

The invention claimed is:

1. A device, comprising:

a case for receiving and storing a non-push-through blister pack (4) having a plurality of wells (5), the case including an upper part (1) hinged to a lower part (2) defining an interior volume within which an entirety of the non-push-through blister pack (4) is contained;

a plurality of buttons (10) located on the upper part (1) of the case, each button (10) being in registration with a respective one of the plurality of wells (5); and retaining elements (6) disposed within the lower part (2), which act as a support structure (6), and which are suitable for fixing the non-push-through blister (4) within the lower part (2), wherein:

as a result of actuation of a respective one of the buttons (10), a respective cover film of the respective blister well (5) of the blister pack (4) is punched around a tablet or capsule (12) within such well (5), such that the tablet or capsule (12) may be taken out of the respective blister well (5)

respective mouldings of the respective blister wells (5) point towards the lower part (2) as the non-push-through blister is inserted and thus the non-push-through blister (4) is secured against lateral movement, a base height of the support structure (6) corresponds at least to a depth of indentation of the blister wells (5), the buttons (10) each include a respective wall with a cutting edge and/or teeth for each of the respective blister wells (5), so that when the respective button (10) is actuated the cutting edge and/or teeth cut open the respective cover film of the respective blister well (5), and before the actuation of the respective button (10), the holding position of the cutting edge and/or teeth is spaced by a support structure (9) and/or a strut (7) from the cover film of the non-push-through blister (4) placed in the device, and after actuation of the respective button (10) the cutting edge and/or the teeth make a circular, segment-shaped, semicircular, arcuate or oval cut in the respective cover film at a spacing from the tablet or capsule (12).

2. The device according to claim 1, wherein after actuation of the respective button (10) the cutting edge and/or the teeth penetrate the respective cover film by 1 or at most 2 mm.

3. The device according to claim 1, wherein the device is suitable for accommodating an at least a 2-row, non-push-through blister (4) and the upper part (1) contains a strut (7) which when the device is closed presses the non-push-through blister into the lower part, thus ensuring that in the resting position the respective cutting edge and/or teeth of are spaced from the respective cover film.

4. The device according to claim 1, wherein the upper part (1) including the buttons (10) and the strut (7) are made from a single plastics part, the buttons (10) for punching out the tablet or the capsule (12) being movably attached to the upper part (1), while the circular, segment-shaped, semicircular, arcuate or oval means are separated from the upper part (1) by a slot, apart from a connecting point, so that the buttons (10) are attached to the cover only on one side, the connecting point in the form of a pivot having a material attenuation, and the buttons (10) being capable of being resiliently lowered onto it by pressing.

5. The device according to claim 1, wherein the device has the capacity to hold a patient's medication that the patient will need for 7 days, the being administered twice a day, in the morning and evening, and the respective button is characterised by a symbol (11*a*) or (11*b*), so that the medication can be assigned to a morning or evening administration, and the device comprises markings (13) which permit allocation of the medication that is needed on a particular day of the week.

6. The device according to claim 1, wherein the non-push-through blister (4) contains a pharmaceutical formulation containing dabigatran etexilate.

7. The device according to claim 1, wherein the non-push-through blister (4) contains inhalation capsules as a medicament.

8. The device of claim 7, wherein the inhalation capsules comprise an active substance tiotropium.

9. The device of claim 1, further comprising:

at least one strut (7) extending from an inside surface of the upper part (1) toward the lower part (2) and engaging the lower part (2) when the case is closed, wherein:

the at least one strut (7) is elongate in a longitudinal direction along the upper part (1), and at least one of the plurality of buttons (10) is disposed on a first lateral side of the at least one strut (7), and at least one other of the plurality of buttons (10) is disposed on a second, opposite, lateral side of the at least one strut (7).

10. The device of claim 9, further comprising:

at least one support structure (9) extending from an inside surface of the lower part (2) toward the upper part (1) and engaging the at least one strut (7) when the case is closed, wherein:

the at least one support structure (9) is elongate in a lateral direction, transverse to the longitudinal direction, across the lower part (2).

* * * * *